US012540007B2

(12) United States Patent
Al-Shehri et al.

(10) Patent No.: US 12,540,007 B2
(45) Date of Patent: Feb. 3, 2026

(54) LIGHT WEIGHT PLASTIC PALLET

(71) Applicant: National Industrialization Company (TASNEE), Riyadh (SA)

(72) Inventors: Hamdan A. Al-Shehri, Al Jubail Industrial (SA); Mukesh K. Yadav, Al-Jubail Industrial (SA); Mohammed Ali Ghanchi, Al-Jubail Industrial (SA)

(73) Assignee: National Industrialization Company (TASNEE), Riyadh (SA)

( * ) Notice: Subject to any disclaimer, the term of this patent is extended or adjusted under 35 U.S.C. 154(b) by 0 days.

(21) Appl. No.: 18/906,835

(22) Filed: Oct. 4, 2024

(65) Prior Publication Data

US 2025/0058933 A1 Feb. 20, 2025

Related U.S. Application Data

(63) Continuation of application No. 18/807,661, filed on Aug. 16, 2024.

(60) Provisional application No. 63/519,917, filed on Aug. 16, 2023.

(51) Int. Cl.
*B65D 19/00* (2006.01)

(52) U.S. Cl.
CPC ..... *B65D 19/0036* (2013.01); *B65D 2519/00034* (2013.01); *B65D 2519/00069* (2013.01); *B65D 2519/00268* (2013.01); *B65D 2519/00288* (2013.01); *B65D 2519/00308* (2013.01); *B65D 2519/00318* (2013.01); *B65D 2519/00363* (2013.01)

(58) Field of Classification Search
USPC ..... 108/57.28, 57.25
See application file for complete search history.

(56) References Cited

U.S. PATENT DOCUMENTS 3,667,403 A * 6/1972 Angelbeck, Jr. ... B65D 19/0012 108/57.26
3,759,194 A * 9/1973 Fujii ..... B65D 19/0012 108/901
3,916,803 A * 11/1975 Garcia ..... B65D 19/0034 108/55.3
3,964,400 A * 6/1976 Brand ..... B65D 19/0012 108/57.25
4,013,021 A * 3/1977 Steinlein ..... B65D 19/0069 108/57.25
5,967,057 A * 10/1999 Nakayama ..... B29C 45/1704 108/57.25

(Continued)

FOREIGN PATENT DOCUMENTS

CN 103387079 A 11/2013

OTHER PUBLICATIONS

International Search Report and Written Opinion dated Dec. 10, 2024 for PCT/IB2024/057975 filed Aug. 16, 2024.

*Primary Examiner* — Jose V Chen
(74) *Attorney, Agent, or Firm* — Dunlap Codding, P.C.

(57) ABSTRACT

The presently disclosed pallet is made of plastic, optionally recycled plastic, is low weight, and can handle weight up to more than 2.75 tons as a stacking load. The pallet has a unique design of ribs forming an upper deck and a lower deck to hold the required load. The upper deck and lower deck of the pallet are separated by a group of legs. Cross ribs are provided in each of the upper and lower decks and are oriented perpendicularly to reduce the weight of the pallet without significantly reducing its strength.

8 Claims, 7 Drawing Sheets

(56) References Cited

U.S. PATENT DOCUMENTS 6,138,582 A * 10/2000 Fujii ..... B65D 19/0069 108/57.25
6,807,910 B2 * 10/2004 Apps ..... B65D 19/38 108/57.25
2002/0104465 A1 * 8/2002 Ohanesian ..... B65D 19/0012 108/57.25
2003/0061974 A1 * 4/2003 Smyers ..... B65D 19/0012 108/57.33
2003/0136314 A1 * 7/2003 Smyers ..... B65D 19/0012 108/57.26
2004/0134391 A1 * 7/2004 Sugihara ..... B65D 19/38 108/57.25
2005/0145144 A1 * 7/2005 Gab ..... B65D 19/38 108/55.3
2007/0186826 A1 8/2007 Kuo
2008/0236455 A1 * 10/2008 Naidu ..... B65D 19/0038 24/453
2010/0288169 A1 * 11/2010 Du Toit ..... B65D 19/0004 108/57.25
2011/0126741 A1 * 6/2011 Sosa Bravo ..... B65D 19/0038 108/57.25
2013/0202731 A1 * 8/2013 Liu ..... B29C 45/332 425/556
2013/0220184 A1 * 8/2013 Apps ..... B65D 19/0004 108/56.1
2014/0261103 A1 * 9/2014 Kelly ..... B65D 19/0012 108/57.33
2016/0288951 A1 * 10/2016 Rader ..... B65D 19/0016
2018/0016059 A1 * 1/2018 Alsanea ..... B65D 19/0069
2019/0135485 A1 * 5/2019 Apps ..... B65D 19/0038
2019/0367215 A1 * 12/2019 D'Emidio ..... B65D 19/0016
2020/0231332 A1 * 7/2020 Apps ..... B65D 19/0036
2020/0283192 A1 * 9/2020 Wood ..... B65D 19/0048
2023/0234750 A1 * 7/2023 Apps ..... B65D 19/385 108/55.1
2024/0059453 A1 * 2/2024 Khandelwal ..... B65D 19/0075

* cited by examiner

LIGHT WEIGHT PLASTIC PALLET

CROSS REFERENCE TO RELATED APPLICATIONS/INCORPORATION BY REFERENCE STATEMENT

This application is a continuation of U.S. Ser. No. 18/807,661, filed Aug. 16, 2024, which claims benefit under 35 USC § 119 (e) of U.S. Provisional Patent Application No. 63/519,917, filed Aug. 16, 2023. The entire contents of each of the above-referenced patent application(s) are hereby expressly incorporated by reference.

BACKGROUND

The following disclosure generally relates to a pallet design and, more specifically, to plastic pallets containing reinforcing parts in the design for greater load bearing ability.

Pallets are traditionally used to store and carry products. Pallets maintain the products at a height above the floor that allows forklifts to easily lift and carry them. Pallets are employed in a variety of industries and are often used to move or ship large and heavy materials.

Wooden pallets with a deck composed of several slats are commonly used, but they have a number of issues limiting their performance. Common issues include pest infestation, cracking, and decomposition. Therefore, wooden pallets must be continuously treated, resulting in substantial maintenance costs. Additionally, the weight of the wood is a disadvantage for shipping.

For many years, it has been an aim to replace wooden pallets with plastic ones. In comparison to wooden pallets, plastic pallets provide several benefits, including increased durability, less weight, more uniform dimensions, enhanced cleanliness, water resistance, and the ability to be recycled. While numerous plastic pallet designs have already been tried, the ones that can come close to the strength of wood are, to date, too expensive or do not have the right strength characteristics.

Compared to the conventional plastic used to build pallets, wood is more rigid. To make up for this discrepancy, plastic pallets require more material or incorporate reinforcements with fillers. For example, solid-section plastic pallets have good stiffness and deflection characteristics, but are hefty and made of a sizable amount of material. Some plastic pallets have ribbed supports to reduce their weight; however, these pallets frequently lack the preferred stiffness and low creep properties of solid pallets.

Although plastic pallets have ribbed supports to reduce their weight, these pallets frequently lack the preferred stiffness and low creep properties of solid pallets. To compensate, the density of the material can be increased; however, these additions to the plastic naturally results in an undesirably heavy pallet.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. In the drawings.

DETAILED DESCRIPTION OF EXEMPLARY EMBODIMENTS

Figure 1:
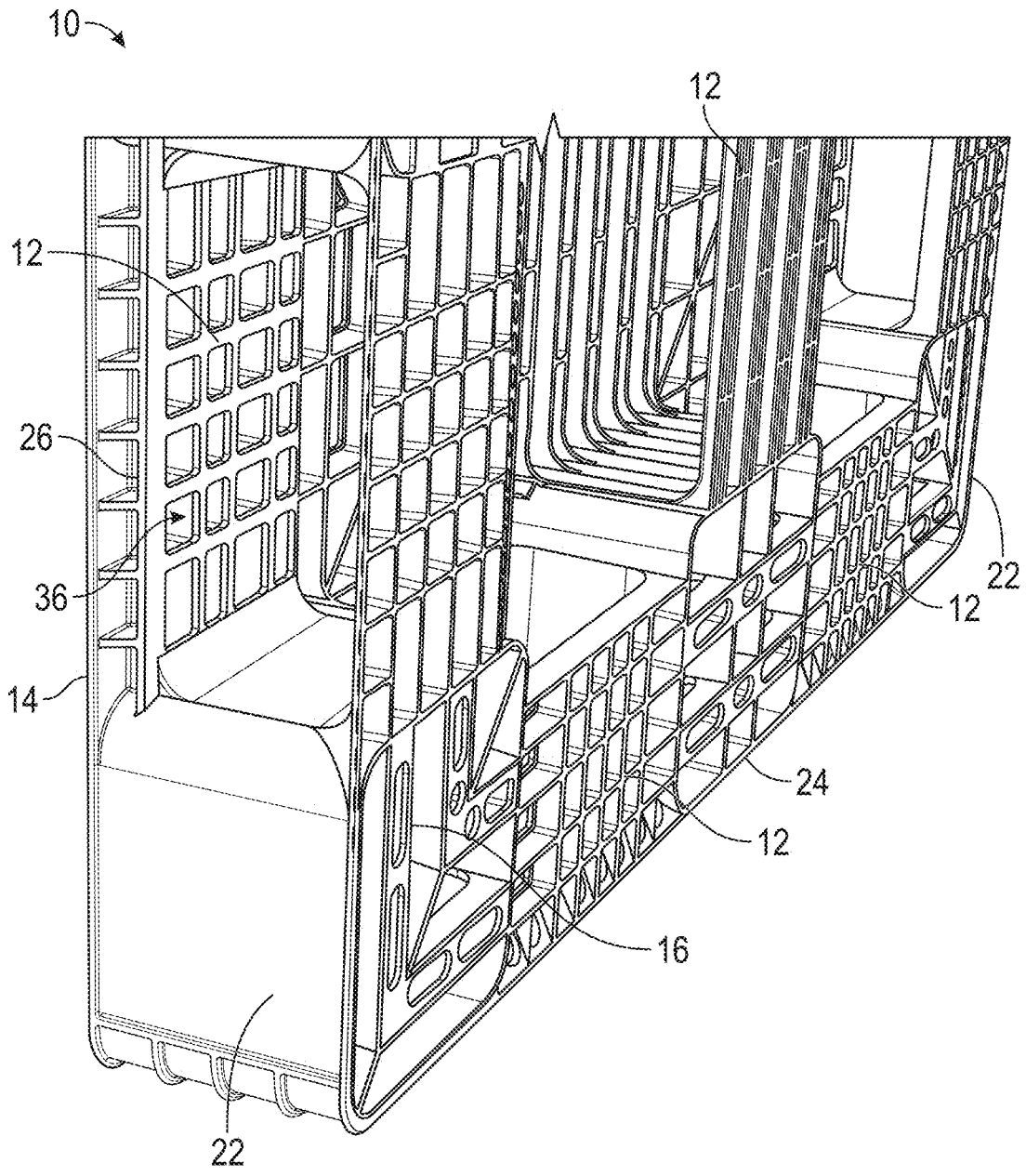
FIG. 1 shows a corner beam from a bottom side of one embodiment of the presently disclosed pallet.

Before explaining at least one embodiment of the present disclosure in detail, it is to be understood that the present disclosure is not limited in its application to the details of construction and the arrangement of the components or steps or methodologies set forth in the following description or illustrated in the drawings. The present disclosure is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the present disclosure shall have the meanings that are commonly understood by those of ordinary skill in the art. Further, unless otherwise required by context, singular terms shall include pluralities and plural terms shall include the singular.

All of the articles and/or methods disclosed herein can be made and executed without undue experimentation in light of the present disclosure. While the articles and methods of the present disclosure have been described in terms of preferred embodiments, it will be apparent to those skilled in the art that variations may be applied to the articles and/or methods and in the steps or in the sequence of steps of the method described herein without departing from the concept, spirit, and scope of the present disclosure. All such similar substitutes and modifications apparent to those skilled in the art are deemed to be within the spirit, scope, and concept of the present disclosure.

As utilized in accordance with the present disclosure, the following terms, unless otherwise indicated, shall be understood to have the following meanings:

The use of the word "a" or "an" when used in conjunction with the term "comprising" in the claims and/or the specification may mean "one", but it is also consistent with the meaning of "one or more," "at least one," and "one or more than one." The use of the term "or" in the claims is used to mean "and/or" unless explicitly indicated to refer to alternatives only or that the alternatives are mutually exclusive, although the disclosure supports a definition that refers to only alternatives and "and/or."

Throughout this application, the term "about" is used to indicate that a value includes the inherent variation of error for the device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one of X, Y, and Z" will be understood to include X alone, Y alone, and Z alone, as well as any combination of X, Y, and Z. The use of ordinal number terminology (i.e., "first," "second," "third," "fourth," etc.) is solely for the purpose of differentiating between two or more items and is not meant to imply any sequence or order or importance to one item over another or any order of addition, for example.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. The term "substantially adjacent" may mean that two items are 100% adjacent to one another, or that the two items are within close proximity to one another but not 100% adjacent to one another, or that a portion of one of the two items is not 100% adjacent to the other item but is within close proximity to the other item.

The term "associate" as used herein will be understood to refer to the direct or indirect connection of two or more items.

Figure 2:
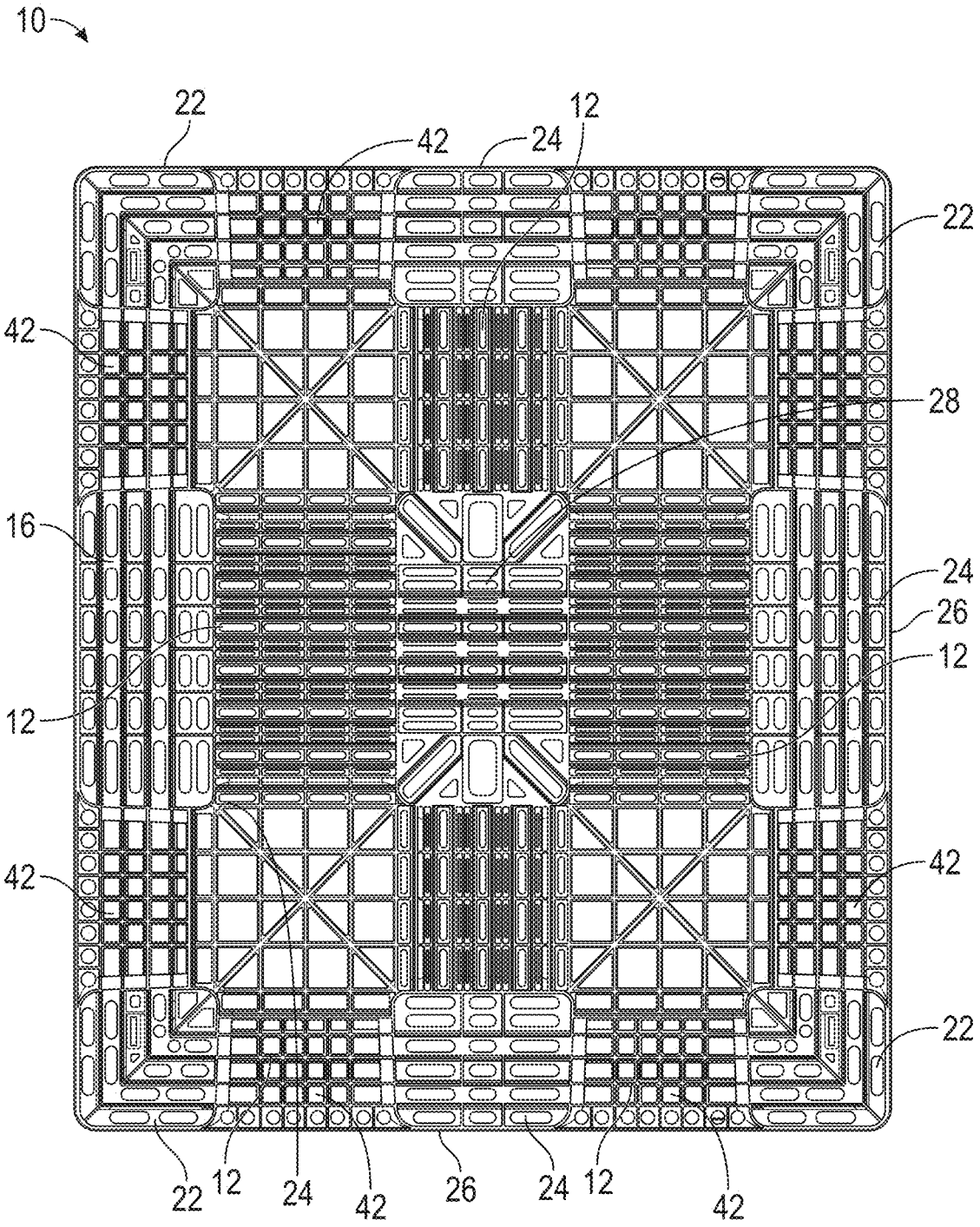
FIG. 2 is a bottom view of an embodiment of the presently disclosed pallet.
Figure 3:
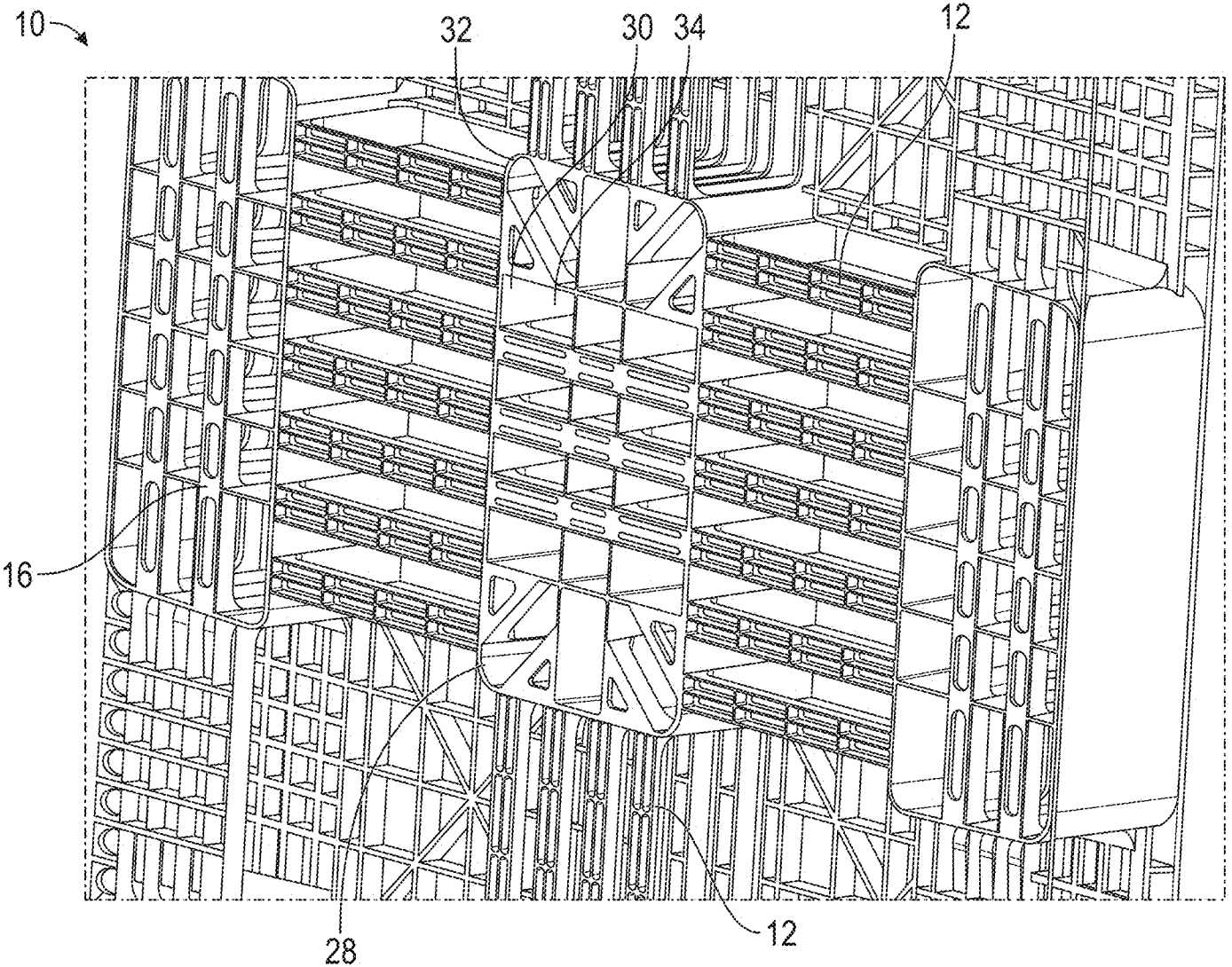
FIG. 3 shows the bottom side ribs of an embodiment of the presently disclosed pallet.
Figure 4:
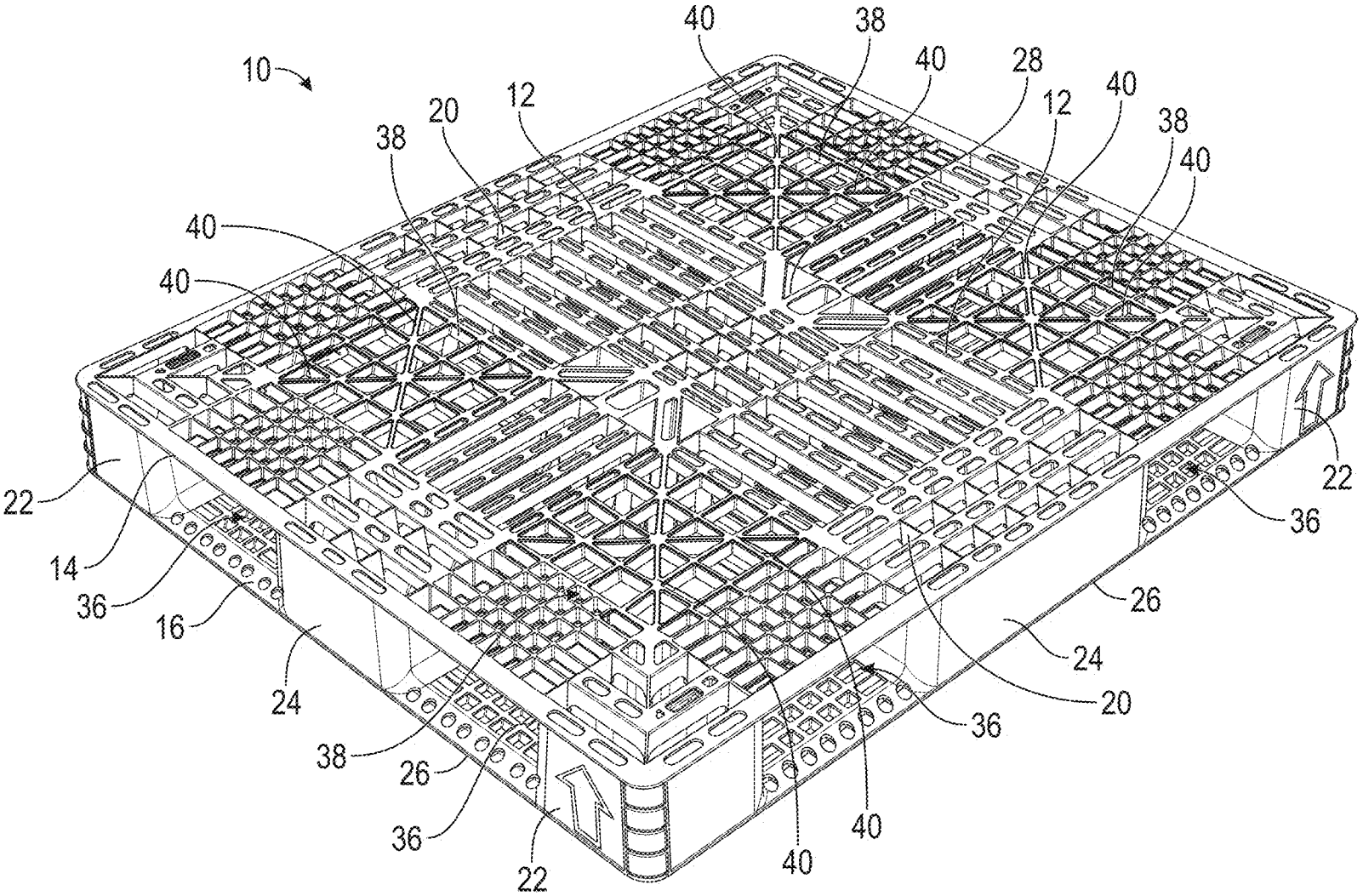
FIG. 4 is an oblique view of an embodiment of the presently disclosed pallet.
Figure 5:
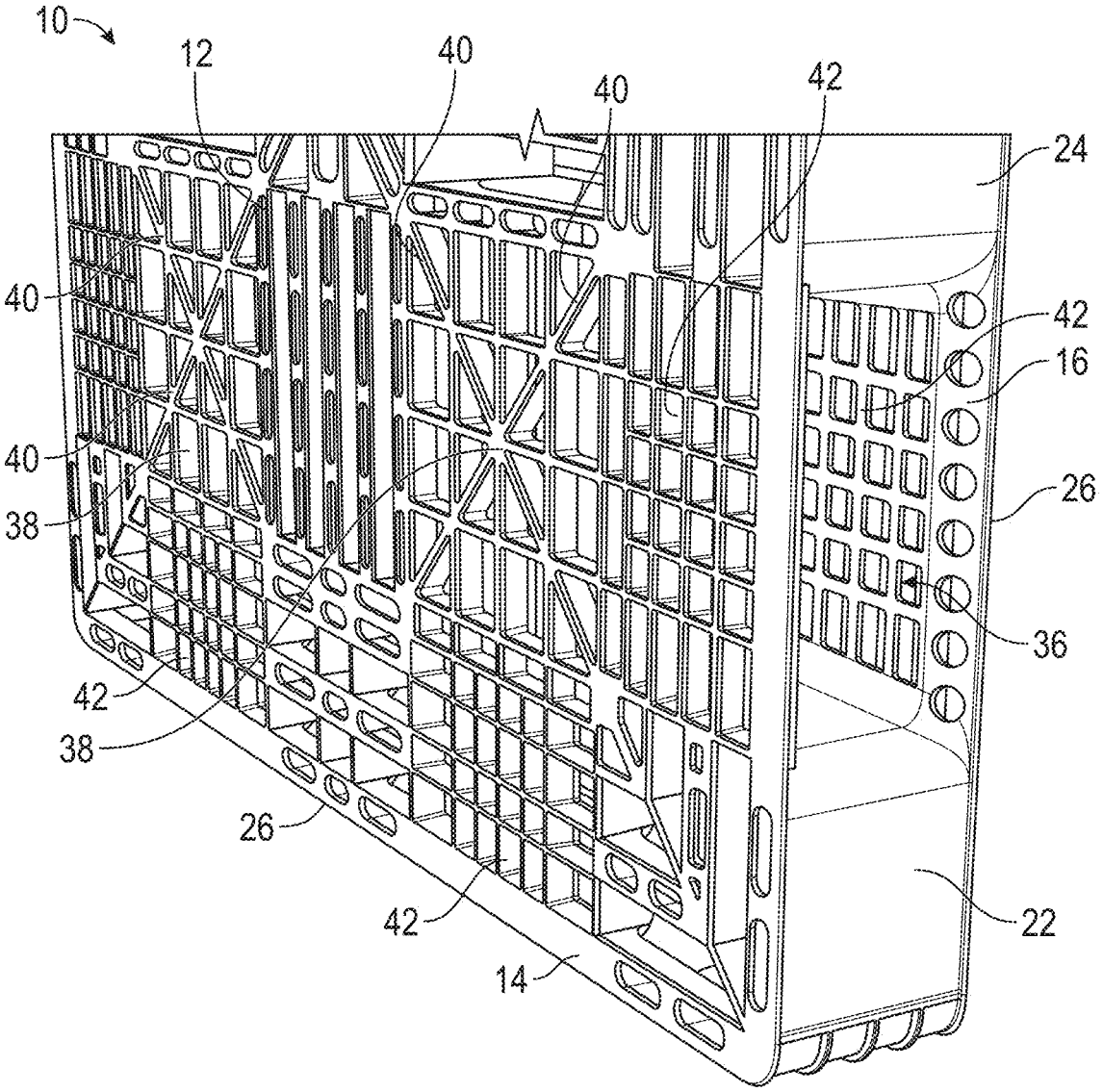
FIG. 5 shows a corner beam from the top side of an embodiment of the presently disclosed pallet.
Figure 6:
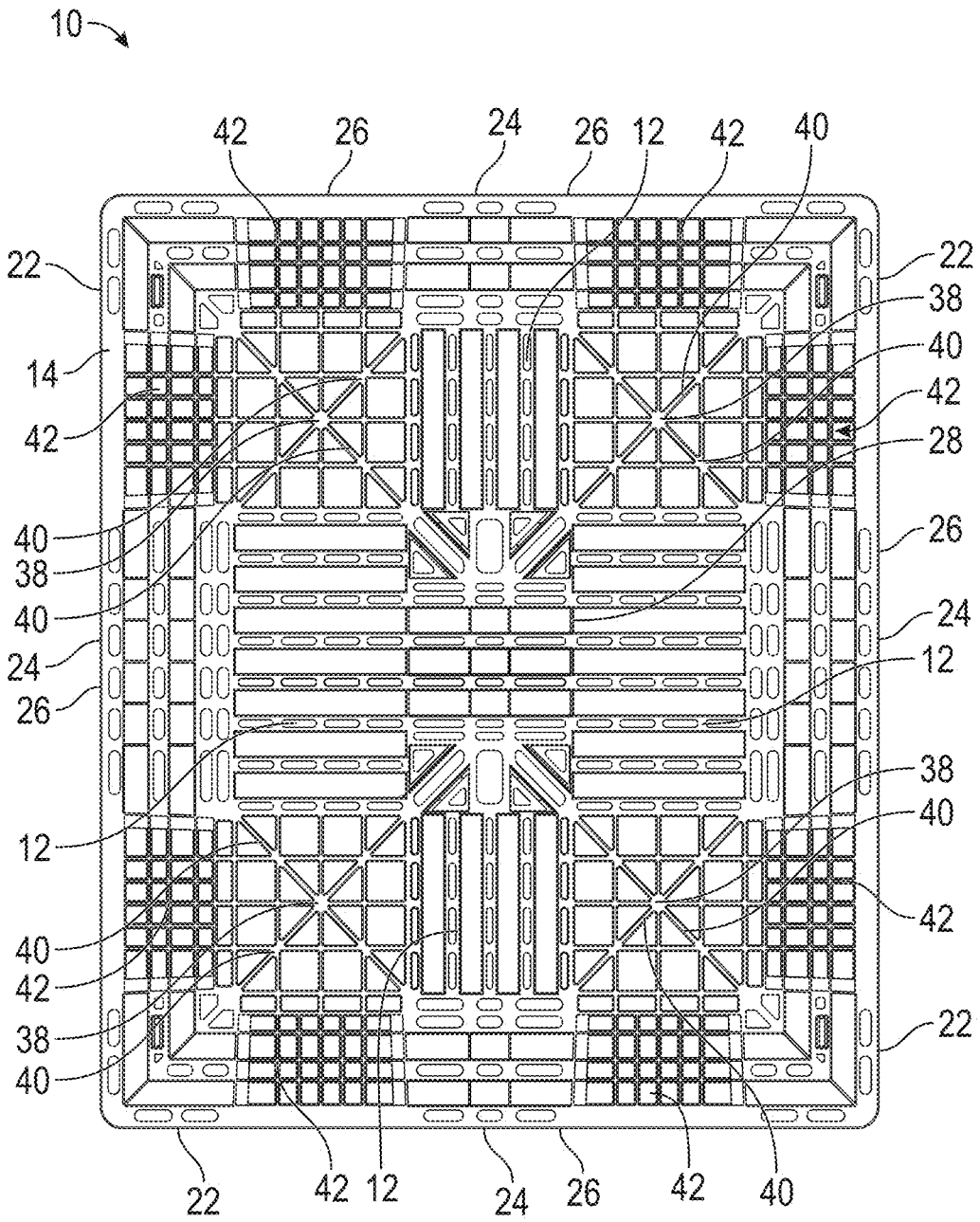
FIG. 6 is a top view of an embodiment of the presently disclosed pallet.
Figure 7A:
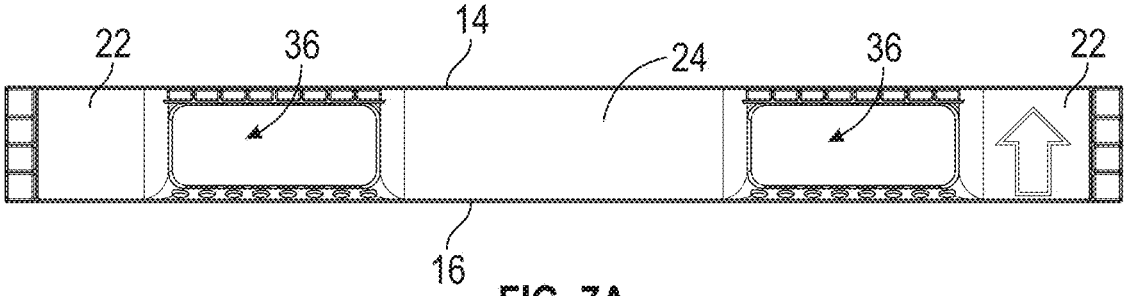
FIG. 7A is a front view of an embodiment of the presently disclosed pallet.
Figure 7B:
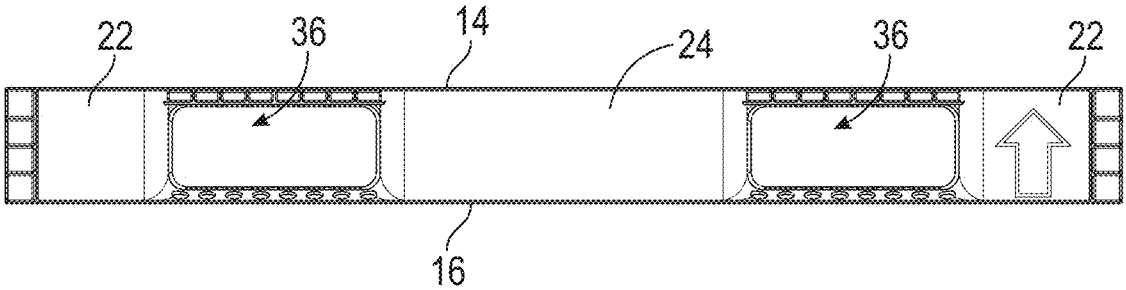
FIG. 7B is a back view of an embodiment of the presently disclosed pallet.
Figure 7C:
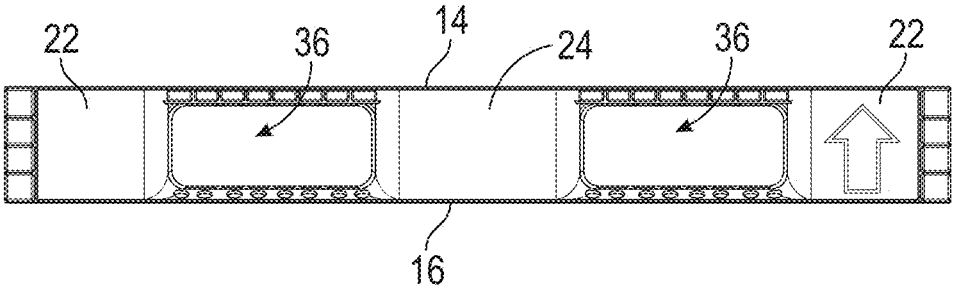
FIG. 7C is a right side view of an embodiment of the presently disclosed pallet.
Figure 7D:
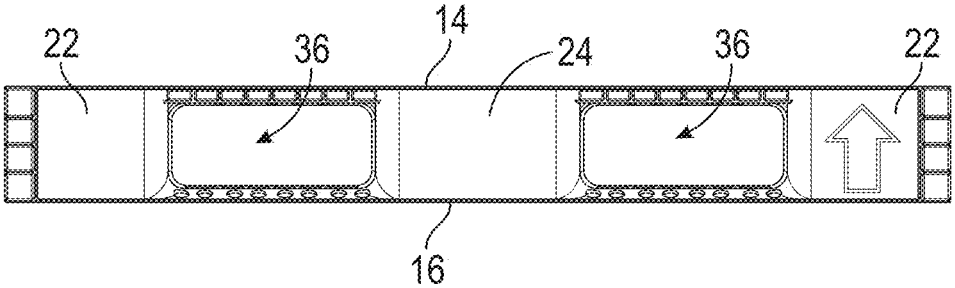
FIG. 7D is a left side view of an embodiment of the presently disclosed pallet.

The presently disclosed pallet is made of plastic, optionally recycled plastic, is low weight, and can handle weight up to more than 2.75 tons as a stacking load. Referring now to FIGS. 1-7, the pallet 10 has a unique design of ribs 12 forming an upper deck 14 and a lower deck 16. This design helps to hold the required load. The upper deck 14 and lower deck 16 of the pallet 10 are separated by a group of legs. Cross ribs 12 are provided in each of the upper and lower decks and are oriented perpendicularly to reduce the weight of the pallet without significantly reducing its strength.

In one embodiment, the weight of the ribs 12 is reduced using various holes and oval shapes. Reinforcement is obtained with strips of ribs 12 and short-sided walls 20 acting as internal supports and positioned parallel to the legs. This decreases the size and weight of the upper reinforcement element while maintaining the upper deck's support.

In one embodiment, the pallet 10 has nine legs. Four corner legs 22 have the same size and shape and are positioned along corners of the pallet 10. Four middle legs 24 are positioned in the middle of each pallet side 26, and a center leg 28 is positioned in the center of the pallet 10 to connect the upper deck 14 with the lower deck 16. The center leg 28 is the largest that has an inner surface 30 of a surrounding wall 32 enclosing a hollow area 34. The center leg 28 is composed of a number of alternately organized and angularly offset slopes and troughs to provide support with minimum weight.

The dimensions of a gap 36 between every corner leg 22 and middle leg 24 is aligned such that the gaps 36 will allow a forklift to reach the other side of the pallet 10 for lifting.

The center leg 28 is connected with all middle legs 24 by a number of ribs 12 from upper and lower decks. The ribs 12 have a U-shape towards the inner side of the pallet 10. Similarly, the lower deck 16 has the same set of components toward the inner side but with fewer number and facing the gap 36 between the upper deck 14 ribs. The lower deck 16 functions to avoid bending of the pallet by reaction forces during lifting and to support the pallet 10 during stacking two pallets on top of another.

The legs do not obstruct the insertion of forklift forks, allowing the pallet 10 to be carried by the forks. The upper deck 14 is connected with ribs on square patterns 38 and with two diagonal ribs 40 intersecting in the middle. On the other hand, the lower deck 16 is free on every corresponding quadrant because the lower deck 16 is not a loading area and thus the weight of the pallet 10 is reduced.

In one embodiment, the corner legs 22 and middle legs 24 are connected with a square shaped rib component 42 from the deck sides to strengthen the areas on top and bottom of forklift inlets and to support the edges of the top deck while carrying the load.

Thus, in accordance with the presently disclosure, there has been provided a light weight plastic pallet having excellent loading characteristics. Although the presently disclosure has been described in conjunction with the specific language set forth herein above, it is evident that many alternatives, modifications, and variations will be apparent to those skilled in the art. Accordingly, it is intended to embrace all such alternatives, modifications, and variations that fall within the spirit and broad scope of the present disclosure. Changes may be made in the construction of the various components, elements, and assemblies described herein, without departing from the spirit and scope of the present disclosure.

The invention claimed is:

1. A low weight plastic pallet comprising:

an upper pallet deck and a lower pallet deck, each deck comprising perpendicularly oriented cross ribs, such that the weight of the pallet is reduced without substantially reducing its strength;

four corner legs, each having the same size and shape and positioned along corners of a rectangular pallet;

four middle legs, each centrally positioned along a side of the pallet; and a center leg positioned in the center of the pallet and connecting the upper pallet deck with the lower pallet deck, wherein the center leg comprises a hollow area and a number of alternately organized and angularly offset slopes and troughs to provide support with minimum weight, wherein each set of adjacent middle legs, the intervening corner leg between them, and the center leg define a square pattern; the square patterns of the upper deck comprising diagonally oriented ribs intersecting in the middle of the diagonally oriented ribs.

2. The plastic pallet of claim 1, wherein a first diagonally oriented rib extends diagonally from the center leg to a corner leg and intersects with a second diagonally oriented rib extending from a first adjacent middle leg adjacent to the corner leg to a second adjacent middle leg.

3. The plastic pallet of claim 1, further comprising short-sided walls providing internal support and positioned parallel to the legs.

4. A low weight plastic pallet configured in the shape of a rectangle having four corners, said pallet comprising:

perpendicularly oriented cross ribs comprising an upper pallet deck and a lower pallet deck, wherein one or more ribs contain one or more holes;

four corner legs, each having the same size and shape and positioned along the corners of the rectangular pallet;

four middle legs, each centrally positioned along a side of the pallet to form gaps between the middle legs and the adjacent corner legs, the gaps extending from a side of the pallet to the opposite side of the pallet; and a center leg positioned in the center of the pallet and connecting an upper pallet deck with a lower pallet deck, the center leg comprising a hollow area and a number of alternately organized and angularly offset slopes and troughs to provide support with minimum weight, wherein the upper deck comprises ribs configured to define an octagon.

5. The low weight plastic pallet of claim 4, wherein the center leg is connected to all middle legs with ribs and a rib extends diagonally from each of the corners of the center leg to each of the adjacent corner legs.

6. The low weight plastic pallet of claim 4 wherein the upper deck further comprises ribs forming square patterns, each square comprising diagonally oriented ribs intersecting in the middle of the diagonally oriented ribs, each of said diagonally orienting ribs facing the center leg form four sides of the octagon and wherein four ribs parallel to the sides of the rectangular pallet form four sides of the octagon.

7. The low weight plastic pallet of claim 4, wherein the corner legs are connected to adjacent middle legs with a square-shaped rib component.

8. The low weight plastic pallet of claim 1, wherein the upper deck comprises ribs configured to define an octagon.

* * * * *